US006817610B2

(12) United States Patent
Rompe

(10) Patent No.: US 6,817,610 B2
(45) Date of Patent: Nov. 16, 2004

(54) MULTIPLES DETECT APPARATUS AND METHOD

(75) Inventor: Andre Rompe, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 147 days.

(21) Appl. No.: 10/309,805

(22) Filed: Dec. 3, 2002

(65) Prior Publication Data

US 2003/0132572 A1 Jul. 17, 2003

Related U.S. Application Data

(60) Provisional application No. 60/336,766, filed on Dec. 3, 2001.

(51) Int. Cl.[7] ..... B65H 7/02

(52) U.S. Cl. ..... 271/265.04; 271/258.01; 250/223 R

(58) Field of Search ..... 271/265.04, 258.01; 356/391, 392, 394; 250/223 R

(56) References Cited

U.S. PATENT DOCUMENTS

| | | | | |
|---|---|---|---|---|
| 3,186,708 A | | 6/1965 | Hinz | 271/57 |
| 3,826,487 A | | 7/1974 | Forster et al. | 271/263 |
| 4,691,912 A | | 9/1987 | Gillmann | |
| 4,733,226 A | | 3/1988 | Kasuya et al. | 340/674 |
| 4,998,998 A | | 3/1991 | Shigetoshi et al. | 271/263 |
| 5,015,840 A | | 5/1991 | Blau | 250/221 |
| 5,131,648 A | | 7/1992 | Ito | 271/262 |
| 5,202,557 A | | 4/1993 | Robertson | 250/223 |
| 5,331,151 A | | 7/1994 | Cochran et al. | 250/223 |
| 5,384,450 A | | 1/1995 | Goetz, Jr. | 235/462 |
| 5,502,312 A | | 3/1996 | Lorenzo | 250/559.1 |
| 5,560,598 A | * | 10/1996 | Goldkuhle | 271/263 |
| 5,614,710 A | | 3/1997 | Mondie et al. | 250/223 |
| 5,654,802 A | * | 8/1997 | Kurachi et al. | 356/394 |
| 5,659,396 A | | 8/1997 | Mondie | 356/381 |

(List continued on next page.)

FOREIGN PATENT DOCUMENTS

| | | | |
|---|---|---|---|
| DE | 1210601 | 2/1966 | G07C/42/02 |
| DE | 2028004 | 12/1971 | B07C/1/04 |
| DE | 19625043 | 4/1997 | B07C/1/04 |
| EP | 0 167 091 | 9/1987 | B07C/1/02 |
| EP | 0 813 913 | 5/1997 | B07C/1/02 |
| FR | 2 057 309 | 5/1971 | G06M/7/00 |
| FR | 2 546 083 | 11/1984 | B07C/1/12 |
| FR | 2 576 528 | 1/1985 | B07C/1/02 |
| GB | 2 279 634 | 1/1995 | B07C/1/02 |

*Primary Examiner*—Donald D. P. Walsh
*Assistant Examiner*—Kaitlin Joerger
(74) *Attorney, Agent, or Firm*—Philip G. Meyers

(57) ABSTRACT

The invention provides an apparatus and method for detecting overlapped mail pieces when sorting batches of flat mail pieces as the pieces are conveyed on their narrow sides, whereby the sorted mail pieces are moved successively standing on their narrow sides in a longitudinal direction along a bed or path. Positioned below the path is an electronic line camera arranged with its longitudinal axis perpendicular to the feed direction of the sorted mail pieces that scans the lower narrow edges of the mail pieces through a gap in the bed. In one aspect, two sources of light, such as light emitting diodes, are positioned laterally from the line camera diagonally illuminate the mail pieces from below as the mail pieces pass over a window in the path so that the edges of the scanned narrow sides are emphasized by shadowing. Features of the scanned images are transmitted to an evaluation means that utilizes statistical analyses and compared with models of known physical mail piece configurations determined off-line to determine the model that most agrees with the analysis of the scanned image data. In one aspect the evaluation means comprises a microprocessor that is preprogrammed to compare and statistically analyze the captured image data with reference to standard image data and determine the probability that the scanned image data represents over lapping mail pieces, in which case the microprocessor generates a signal that triggers corrective action.

12 Claims, 4 Drawing Sheets

U.S. PATENT DOCUMENTS

| | | | | |
|---|---|---|---|---|
| 5,841,540 | A | 11/1998 | Mondie | 356/381 |
| 6,236,735 | B1 | 5/2001 | Bjorner et al. | 382/101 |
| 6,314,193 | B1 | 11/2001 | Vodegel | 382/101 |
| 6,401,936 | B1 | 6/2002 | Isaacs et al. | 209/656 |
| 6,471,044 | B1 | 10/2002 | Isaacs et al. | 198/809 |
| 6,484,886 | B1 | 11/2002 | Isaacs et al. | 209/539 |

* cited by examiner

MULTIPLES DETECT APPARATUS AND METHOD

This application claims priority of U.S. Ser. No. 60/336,766, filed Dec. 3, 2001, the entire contents of which are incorporated by reference herein.

TECHNICAL FIELD

The present invention relates to automated mail processing systems, and in particular to a method of detecting overlapping mail pieces in a singulated stream of mail pieces.

BACKGROUND OF THE INVENTION

In conventional mail processing systems, stacks of letters and flats are processed using automated sorting machines including one or more feeders. A problem frequently encountered with mail feeders is double or multiple feeding, i.e. overlapping mail pieces are output by the feeder. When the feeder outputs multiple over lapping mail pieces, the mail pieces cannot be scanned, resulting in mis-sorting and other operational problems. The method and apparatus disclosed herein is designed to detect overlapping mail pieces in a stream of singulated mail piece so that corrective action may be taken.

SUMMARY OF THE INVENTION

The invention provides an apparatus and method for detecting overlapped mail pieces when sorting batches of flat mail pieces as the pieces are conveyed on their narrow sides, whereby the sorted mail pieces are moved successively standing on their narrow sides in a longitudinal direction along a bed or path. Positioned below the path is an electronic line camera arranged with its longitudinal axis perpendicular to the feed direction of the sorted mail pieces that scans the lower narrow edges of the mail pieces through a gap in the bed. In one aspect, two sources of light, such as light emitting diodes, are positioned laterally from the line camera diagonally illuminate the mail pieces from below as the mail pieces pass over a window in the path so that the edges of the scanned narrow sides are emphasized by shadowing. Features of the scanned images are transmitted to an evaluation means that utilizes statistical analyses and compared with models of known physical mail piece configurations determined off-line to determine the model that most agrees with the analysis of the scanned image data. In one aspect the evaluation means comprises a microprocessor that is preprogrammed to compare and statistically analyze the captured image data with reference to standard image data and determine the probability that the scanned image data represents over lapping mail pieces, in which case the microprocessor generates a signal that triggers corrective action.

In another aspect, the device the brightness and/or intensities of the scanned lines are determined and selected to be stored and the lines with the same number of intensity maxima are combined into segments, whose differentiating segment features include number of intensity maxima, sequence and features of segments. These segments and features are compared with the appropriate known models and the model with the largest agreement is selected as the recognition result.

In yet another aspect, a method of detecting multiple, overlapping mail pieces in a stream of mail pieces comprises: 1) using a mail piece feeder to successively feed mail pieces on a one by one basis in a singulated stream wherein the mail pieces are conveyed on edge; 2) conveying the mail pieces along a path including a gap or window over which the mail pieces pass on edge; 3) scanning the mail pieces to capture a series of images comprising a linear array of pixels having varying intensities; 4) analyzing the series of linear images to determine whether one or more than one mail piece is passing by the window at the same time; and optionally 5) taking corrective action if a double, multiple or other abnormal feeding condition is detected.

DETAILED DESCRIPTION

Although various embodiments of the invention have been illustrated in the accompanying drawings and described in the foregoing detailed description, it will be understood that the invention is not limited to the embodiments disclosed but, as will be appreciated by those skilled in the art, is susceptible to numerous modifications and variations without departing from the spirit and scope of the invention as hereinafter claimed.

Figure 1:
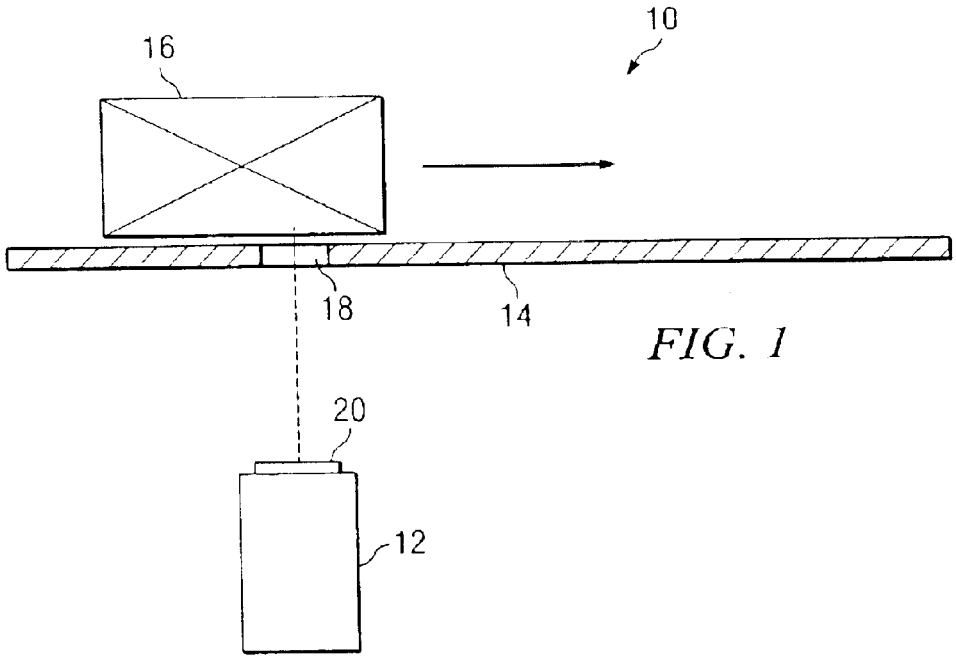
FIG. 1 is a side view of an apparatus according to the invention.
Figure 2:
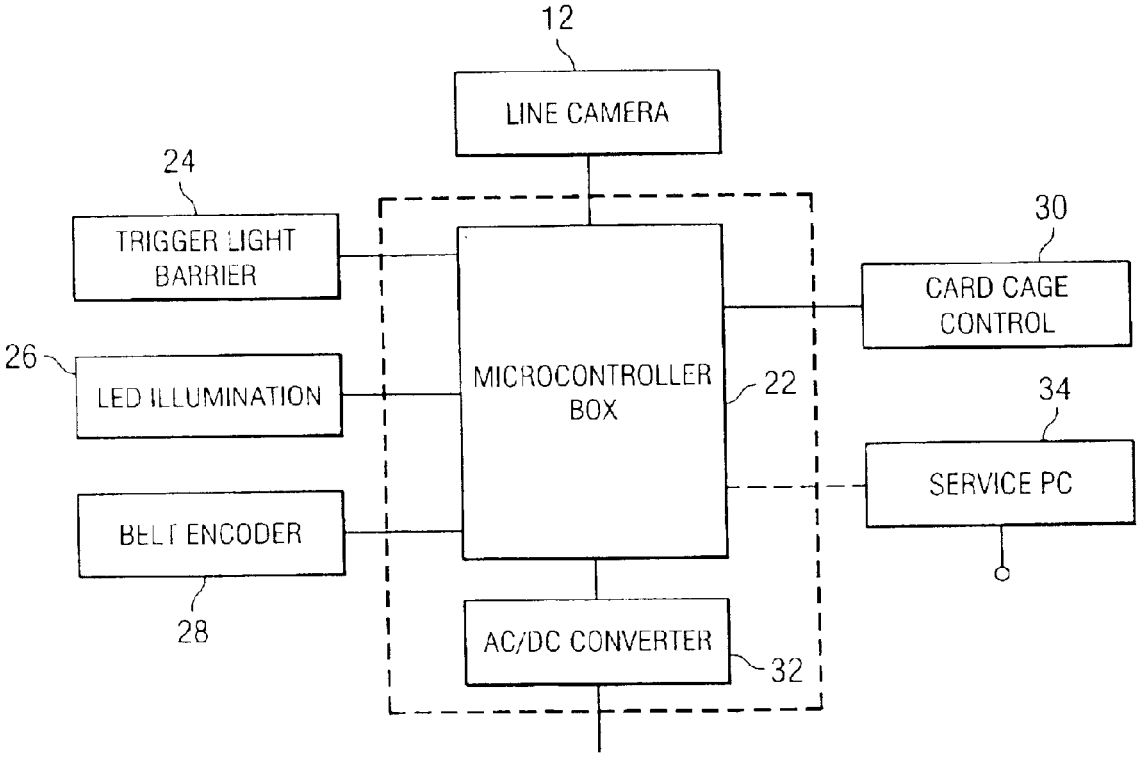
FIG. 2 is a schematic diagram of the apparatus of FIG. 1, including the control system.
Figure 3:
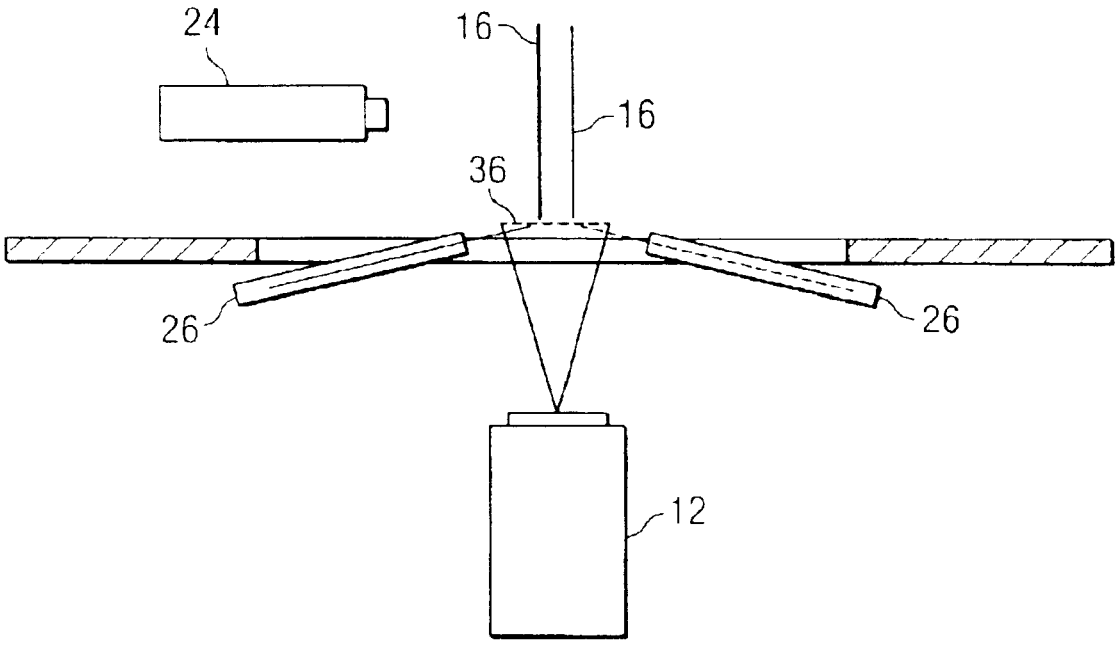
FIG. 3 is a front view of the apparatus of FIG. 1.

Turning to FIGS. 1–3, the doubles detect apparatus 10 of the invention includes a line camera 12 positioned below and with its field of vision perpendicular to the path 14 of singulated stream of letters 16 to be checked for overlapping pieces as the letters are conveyed as indicated by the arrow in FIG. 1. In one embodiment, letters or similar flat mail pieces 16 are conveyed along path 14 between pairs of opposed belts or rollers (not shown) with a window 18 positioned between the pairs of opposed belts or rollers. Line camera 12 is positioned below a window 18 to acquire digital images of the bottom edge of mail pieces 16 passing across and over window 18 at predetermined intervals. As used herein, the term "line camera" refers to a camera equipped and configured to capture a narrow or linear image. In one embodiment, the image captured by line camera 12 comprises a linear 256 pixel camera. Digital images captured by camera 12 are transmitted to microprocessor 22 at predetermined intervals for processing. As illustrated, camera 12 is provided with a transparent cover such as glass cover 20 for protecting the camera from dust and foreign materials.

Apparatus 10 is also provided with a sensor 24 to detect a mail piece approaching window 18 and activate camera 12. In a preferred embodiment, sensor 24 is a photocell, however other known sensors may be utilized, depending upon the particular design and application. Apparatus 10 is also provided with one or more light sources such as light emitting diodes (LEDs) 26 for illuminating objects such as letters passing across window 18. Light sources 26 may emit light in the visible, infrared or UV spectrum depending upon the particular design and application.

As best illustrated in FIG. 2, microprocessor 22 is connected to sensor 24, a belt encoder 28, light sources 26, a card cage controller 30, and a power source 32. Belt encoder 28 provides microprocessor 22 a signal corresponding to the velocity of the conveying belts (not shown) which carry mail pieces along path 14. Card cage controller 30 includes a communications port such as an RS232 interface for communicating with a host computer (not shown). A remote programming and/or diagnostic unit such as personal computer 34 is also provided to program, test and diagnose the operation of microprocessor 22.

Referring to FIG. 3, a pair of overlapping letters 16 are shown crossing window 18. Line camera 12 captures a series of successive images of the letters 16 across a field of view represented by dashed line 36 and transmits the image data to microprocessor 22 for processing. As explained in detail below, microprocessor 22 processes the captured image data to determine image characteristic parameters and compares such parameters to image characteristic parameters for standard images processed previously (off line). Microprocessor 22 may then determine that there is a high probability that the captured image represents a pair of overlapping letters, for example. Microprocessor 22 then generates a signal that triggers corrective action. For example, the signal may be transmitted to a diverter which is activated to divert the overlapping mail pieces for further processing.

In operation, microprocessor 22 receives a signal from sensor 24 indicating that a mail piece is about to cross window 18 and signals camera 12 to begin capturing image data. The image data may be captured at intervals based either on the signal from belt encoder 28 or at a previously set time interval depending upon the particular design and application. Upon receiving the image data, microprocessor 22 builds or constructs a digital image of the bottom edge of the mail piece or pieces. The digital image includes areas of maximum intensity or brightness which are analyzed in segments to construct a model which represents the physical configuration of the bottom edges of the mail piece or pieces scanned with camera 12.

Parameters derived from the constructed image are compared to models based upon standard images using statistical analysis techniques to determine the probability that the constructed image matches one of the standard images. Based upon the results of the analysis, a determination is made as to probability that the captured image corresponds to one of the standard models, i.e., the probability that a particular image represents a single mail piece or overlapping mail pieces. If the results of the analysis indicate a high probability that the constructed image represents overlapping mail pieces, microprocessor 22 generates and transmits a signal to the host computer or a downstream controller for implementation of corrective action.

The standard image models that microprocessor 22 uses for comparison will include image data corresponding to single and overlapping mail pieces as well as other mail pieces typically processed by a postal service, for example images corresponding to bi and tri-folded sheets, flats such as magazines or brochures and similar items. These standard or reference images are generated by processing such mail pieces through apparatus 10 and deriving characteristic image parameters for such standard images.

The invention provides a process for the identification of singles, doubles, multiples, and other types of pieces of mail, such as bi-fold and tri-fold, which appear in the spectrum of pieces of mail. The purpose of the algorithm of the invention is to make a decision on the presence of a single or non-single according to the image information supplied by the line camera. The DFD algorithm includes the following steps:

1. Line-by-line scanning of the edge image
2. Calculation of the line feature vectors
3. Segmentation of the lines
4. Calculation of segment characteristic features
5. Calculation of the hypothesis probability
6. Hypothesis decision To carry out line-by-line scanning of the edge image, the scanning of the line camera is controlled by a letter path light barrier that is arranged over the scanning plane of the camera. The scanning begins directly before the piece of mail enters with its leading edge into the visible field of the camera and ends after the trailing edge of the piece of mail has left the visible field of the camera.

The line scan rate is selected so that the geometric relationship of the object image of successive lines is maintained in every case. The line scan distance in relation to the line scan rate above the belt speed should be between 0.2 mm and 3 mm for given belt speed. The camera measurement window is set by dimensioning the focal length to approximately 25 mm. For the use of a 256 pixel line, there results a corresponding resolution of approximately 256 dpi.

Calculation of the line-feature vectors is made from the scanned values (8-bit gray levels) of the pixels. For each line $Z_k$:

| | |
|---|---|
| Number of maxima in the line | $N_{Max}$ |
| Position (for the ith maximum) | $p_i$ (Index 0–255) |
| Maximum intensity (for the ith maximum) | $I_i$ (Byte) |
| Intensity of the left local minimum | $I_{Li}$ (Byte) |
| Distance to the left minimum | $d_{Li} = P_1 - P_{L1}$ |
| Intensity of the right local minimum | $I_{Ri}$ (Byte) |
| Position of the right minimum | $p_{Ri}$ |
| Distance to the right minimum | $d_{Ri} = P_{R1} - P_1$ |
| Line width | $b_i = D_{Li} + D_{Ri}$, |

-continued

| | |
|---|---|
| Line spacing (between maxima, or edges) | $Dx_i = p_i - p_{i-1}$ for i > 1 |
| Contrast to left | $k_{Li} = I_i/Max(1, I_{Li})$ for i > 0 |
| Contrast to right | $k_{Ri} = I_i/Max(1, I_{Ri})$ for i > 0 |

The line contrast is a measure of the intensity relationships between the maxima and the corresponding minima. As a rule, the edges are assumed to have the intensity 0. The number of minima is always $N_{max}-1$. For $N_{max}=2$:

$$k(2)=\tfrac{1}{2}[(I_1-I_{R1})+(I_2-I_{L1})]$$

For $N_{max}=3$:

$$k(3)=\tfrac{1}{4}[(I_1-I_{R1})+(I_2-I_{R1})+[(I_2-I_{R2})+I_3-I_{R2})]$$

The line contrast is calculated in general for $N_{max}$ edges:

$$k(N_{max})=1/(2(N_{max}-1))(I_1+2*I_2+2*I_3 \ldots 2*I_{Nmax-1}+I_{Nmax})-2*\Sigma I_{Ri}$$

Figure 4:
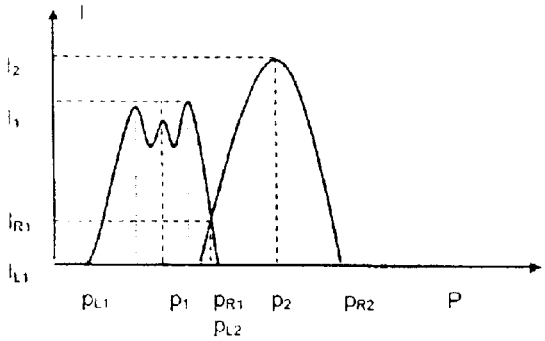
FIG. 4 is a plot of intensity (I) versus position (P) for the intensity profile of a line with two edges from pieces of mail.

FIG. 4 shows an example for the intensity profile of a line with two edges for pieces of mail.

For implementation purposes, the number of lines is not known and can be large in individual cases. The line features are to be implemented dynamically, e.g., in a doubly linked list. Initially, the extreme values are provided with an intensity tolerance that permits slight variations about the minimum and maximum. This intensity tolerance is implemented as a parameter.

Figure 5:
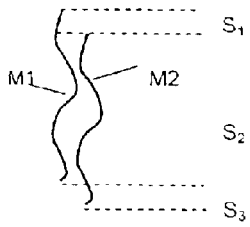
FIG. 5 is a schematic illustration of two mail pieces M1 and M2 representing a typical profile of a double feed mail piece.

Segmentation of the lines is carried out as follows. As a rule, for multiple feeds, the front and rear edges of the pieces of mail are not parallel to each other. For the imaging of the edges, this initially leads to the appearance of one edge, then two (in the case of a double feed) and then one again. FIG. 5 shows this situation schematically. The situation where two pieces of mail begin and end at the exactly same time is a special case, for which the segments $S_1$ and $S_3$ are eliminated. Likewise, there are special cases where only $S_1$ or only $S_3$ is eliminated. The handling of these special cases presents no problem.

For this case, the three segments $S_1$ to $S_3$ are produced. Through the segmentation of the lines, additional features can be derived, which are described by the segment characteristics. The segmenting is performed formally by the combination of lines with the same appearance of one or more chracteristics, e.g., number of maxima. In the example of FIG. 5, all lines of the segments 1 and 3 have one mono-maximum, while segment 2 has a bi-maximum.

The segment characteristic features are determined for each segment:

| | |
|---|---|
| Number of segments: | $N_{Seg}$ |
| For each segment $S_k$: | |
| Number of maxima in segment | $N_{Max}$ |
| Length of the segment (in lines) | $L_{Seg}$ |

Average position of the kth line:

$$\bar{p}_k=1/n\Sigma p_{ki} \quad \text{I.}$$

Variance of the average position for the kth line:

$$V_{pk}=1/(n-1\Sigma(p_i-\overline{p_k})^2 \text{ (for } k>0\text{, summation within the segment limits over } i) \quad \text{II.}$$

Average intensity of the kth line:

$$\bar{I}_k=1/n\Sigma I_{ki} \quad \text{III.}$$

Variance of the average intensity for the kth line:

$$V_{Ik}=1/(n-1)\Sigma(I_i-\bar{I}_k)^2 \text{ (for k>0, summation within the segment limits over i)} \quad \text{IV.}$$

Average line width of the kth line:

$$\overline{b_k}=1/n\Sigma b_{ki} \text{ (summation within the segment limits over i)} \quad \text{V.}$$

Variance line width for the kth line:

$$V_{Lbk}=1/(n-1)\Sigma(b_i-\overline{b_k})^2 \quad \text{VI.}$$

(for k>0, summation within the segment limits over i)

Average line spacing for the kth line relative to the left adjacent line $$\overline{\Delta x_k}=1/n\Sigma\Delta_{ki} \text{ (summation within the segment limits over i)} \quad \text{VII.}$$

Variance line spacing for the kth line relative to the left adjacent line $$V_{LaSk}=1/(n-1)\Sigma(\Delta x_i-\Delta x_k)^2 \text{ (for k>1, summation within the segment limits over i)} \quad \text{VIII.}$$

Average segment contrast:

$$\bar{k}=1/n\Sigma k_i \text{ (summation within the segment limits over i)} \quad \text{IX.}$$

The following analysis shows the connection between the number of identified segments and the resulting sequence of maxima (mono, bi, tri, etc.) and the associated combination of possible alternatives represented by corresponding hypotheses. The hypothesis clusters are the alternatives that compete against each other within a situation for a certain number of segments. In the following table, the hypothesis clusters are summarized according to the number of segments.

| Number of Segments | Maximum Sequence | Hypothesis Clusters: Single Hypothesis | Hypothesis Clusters: Double & Multiple Hypothesis |
|---|---|---|---|
| 1 | Mono | Single | <-> Reject |
| 1 | Bi | Bi-, Tri-Fold | <-> Double |
| 2 | Mono-Bi\|Bi-Mono | Bi-, Tri-Fold | <-> Double |
| 3 | Mono-Bi-Mono | Single | <-> Double |
| | | Bi-, Tri-Fold, | <-> Double |
| | | Edge Defect | <-> Double |
| | | Fold Edge | <-> Reject |
| 4 | Mono-Bi-Mono-Bi | Single | <-> Double |
| 4 | Mono-Bi-Mono-Bi | Bi-, Tri-Fold | <-> Double |
| 5 | Mono-Bi-Mono-Bi | Edge Edge Defect | <-> Double |
| | Mono-Bi-Tri-Bi-Mono | Booklet | <-> Multiple |
| >5 | | Booklet | <-> Multiple |

Figure 6:
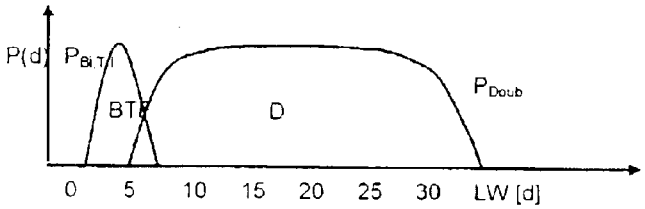
FIG. 6 is a plot of probability distribution P(d) versus line width (LW(d)), representing an assumed probability distribution of the average line thickness for bi-folds and tri-folds (BTF), and doubles (D)
Figure 7:
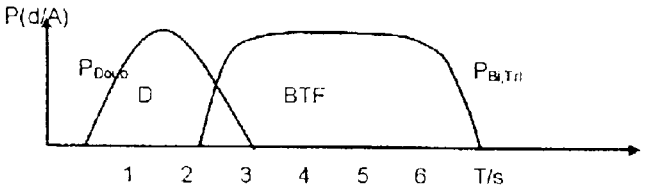
FIG. 7 is a plot of probability distribution P(d/A) versus thickness/spacing (T/s), representing an assumed probability distribution P(d/A) for the ratio of the average line thickness to the average line spacing for bi-folds and tri-folds (BTF), and doubles (D)

Bi- and tri-folds are singles with two visible edges. These contrast with doubles, which also have two visible edges. The corresponding characteristic features, which appear to be especially suitable for differentiating the three cases, are selected for the cluster hypothesis. These are average line width, line spacing/average line width, existence of a tape segment. FIG. 6 shows the probability distribution P(d) to be expected for the line width d for bi-, tri-folds, and doubles. For tri-folds, the thinner line is evaluated. The assumed probability distribution for the ratio of the average line thickness to the average line spacing P(d/A) for bi-folds, tri-folds, and doubles is shown in FIG. 7.

The elements of the tape segment can be determined analytically by determining the average value (MW) and standard deviation(s) of the line thickness by applying the following rule. For the elements of a tape segment of thickness di, the following applies by definition:

$$d_i > MW + \tfrac{1}{2}s \qquad \text{X.}$$

The elements of the tape segment have a significantly greater thickness than the average thickness of the non-tape segment.

Figure 8:
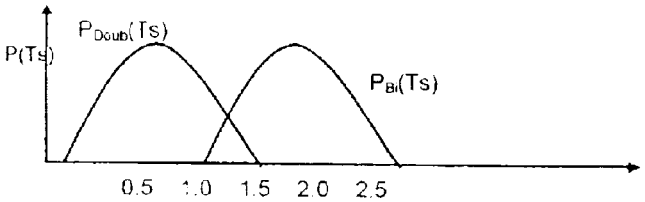
FIG. 8 is a plot of probability distribution P(Ts) versus dispersion s(d), representing dispersion as an indicator for the existence of a tape segment for doubles $P_{Doub}$(Ts) and bi-folds $P_{Bi}$(Ts)

A simple indicator for the existence of the tape segment is the dispersion of the line thickness. This is considerably greater for the presence of a tape segment, as illustrated in FIG. 8. The hypothesis value for the hypothesis cluster bi-tri-fold versus double is calculated from the overlapping of the probability ratios of the appropriate bi-fold, tri-fold distribution to the corresponding double distribution, as illustrated in FIGS. 6–8.

$$H_{Bi,Tri\text{-}Dou} = \ln\frac{P_{Bi,Tri}(\overline{d})}{P_{Doub}(\overline{d})} + \ln\frac{P_{Bi,Tri}(\overline{d/A})}{P_{Doub}(\overline{d/A})} + \ln\frac{P_{Bi,Tri}(Ts)}{P_{Doub}(TS)} \qquad \text{XI.}$$

If a single piece of mail has an unbent front edge for the piece of mail, as a rule, this piece of mail is to be rejected, because further processing is not possible. The features suitable for differentiating against the double hypothesis are: (1) three segments, (2) $S_1$ is very short and correlated with the line thickness, and (3) the segment $S_2$ is shorter than a typical piece of mail. Fold edge length of the piece of mail $L_{Sdg}=2(L_{S1}+L_{S2})+S_3$.

A hypothesis decision process of the invention is as follows. The scanning is performed line-by-line (e.g., 256 pixels/line). The scanning values are then transferred into the memory of the microcomputer. Line-by-line calculation is then carried out of characteristic line-structure features, such as, for all maxima: ordinal number, beginning index, ending index, min, max, 50% width, number of maxima (1, 2, 3, . . . ), and spacing of the maxima $Dx_{12}$, $Dx_{23}$. . . . The purpose of the algorithm is to make a decision on the presence of a single or non-single from the image information supplied by the line camera.

Figure 9:
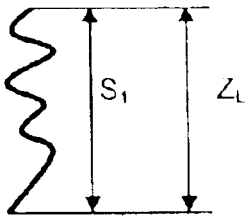
FIG. 9 is a schematic illustration of a single feed standard hypothesis.

FIGS. 9 to 16 illustrate examples of hypotheses according to the process of the invention which enable recognition by software of various types of mail feeds. A single as shown in FIG. 9 is expected to have one segment of the mono-maximum type, expected range for line width 0.25–10 mm. For a skewed mail piece, $S_1<Z_1$, a reject condition.

Figure 10:
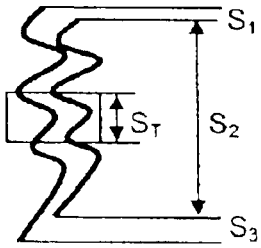
FIG. 10 is a schematic illustration of a bi-fold hypothesis.

For a bi-fold hypothesis as shown in FIG. 10, the number of segments may vary from 1 to 3. A bi-fold piece of mail consists of a once folded sheet, which is fastened together in the middle by tape. Due to this arrangement, both edges of the piece of mail appear to be just as thin. At the beginning and end, slight shifts in the edges of the pieces of mail can occur. According to whether the folded edge is at the top or bottom relative to the envelope run, the image has one or two edges for the piece of mail. Here, only the case is discussed for which the two edges of the piece of mail are oriented downwards, because the other case corresponds to the standard-single array.

Figure 11:
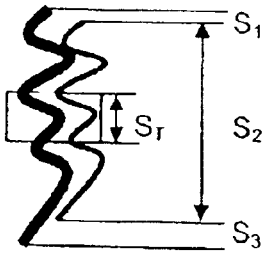
FIG. 11 is a schematic illustration of a tri-fold hypothesis.

According to tri-fold hypothesis, FIG. 11, the tri-fold piece of mail consists of a twice-folded sheet, which is fastened together in the middle by tape. Due to this arrangement, the folded edge of the piece of mail appears significantly thicker than the other, single case. At the beginning and end, slight shifts of the edges of the piece of mail can occur. As a rule there are three segments, wherein the length of the first and the last is very small relative to the average segment. Approximately in the middle of the piece of mail, the tape causes widening of the lines, reduction of the line spacing, reduction of the contrast. As a rule there is no change in the number of visible lines. Characteristic features: number of segments equal 1–3, a "tape segment" in the middle with differences in line width, spacing, and contrast, $S_1$ of mono maximum type which can disappear in special cases, $S_2$ of bi-maximum type, $S_T$ of bi-maximum type, $S_3$ of mono maximum type (can disappear in special cases), $S_1<<S_2$ & $S_1<<S_3$ (the segments $S_1$ and $S_3$ are very small). In the case of a piece of mail skew, the visible total line length is less than the number of recorded lines. This case is a reject, reject condition $(S_1+S_2+S_3)<Z_L$. The length of the piece of mail corresponds to the segment length $\Sigma S_i$ and must lie in a defined range. Pieces of mail that are too large or too small are rejected, reject condition: Limiting length $1<\Sigma S_i$, $S_i>$Limiting length 2.

Figure 12:
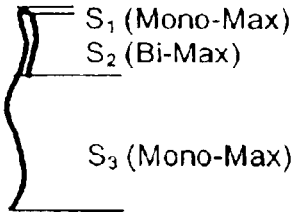
FIG. 12 is a schematic illustration of a single feed standard hypothesis.

According to a fold edge hypothesis, FIG. 12, if a single piece of mail has a bent front edge, then this piece of mail, as a rule, is to be rejected, because further processing is not possible. It is advantageous if there is a special reject compartment (mail for manual processing) for such pieces of mail. This type has at least three segments. The first segment results through the fold of the piece of mail and is thus very short (3 segments—mono-max, bi-max, mono-max). In the case of piece of mail skew, the visible line length is again less than the number of recorded lines, and is a reject condition.

Figure 13:
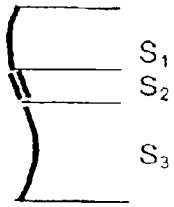
FIG. 13 is a schematic illustration of a defect edge hypothesis.

According to a defect edge hypothesis, see FIG. 13. If a single piece of mail has distorted edges, it means that the edge appears at least partially as a bi-maximum. This piece of mail, as a rule, is not to be rejected, because further processing is possible. The disturbances have narrow spatial limits. The total length of the distorted segments is low relative to the total length of the piece of mail. There is low contrast in the bi-segments, and the number of disturbances is not defined. This type has more than one segment. The sequence of segments is arbitrary and depends on the position and number of edge defects. Characteristic features are a limited number of disturbed segments of type bi-max, a number of segments is equal 1+2 times the number of edge defects, and the total length of the bi-maximum segments makes up only a fraction of the length of the piece of mail.

Figure 14:
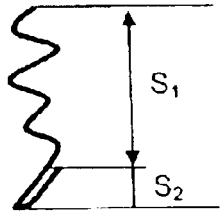
FIG. 14 is a schematic illustration of an open flap hypothesis.

A possible open flap hypothesis is shown in FIG. 14. Two segments are expected, one short and one long.

Figure 15:
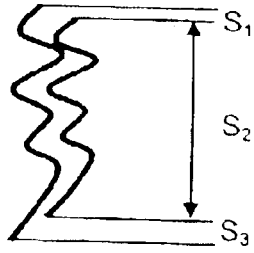
FIG. 15 is a schematic illustration of a double feed standard hypothesis.

According to a standard hypothesis for doubles, see FIG. 15. The standard double piece of mail consists of two pieces of mail pulled off together. The edges of the pieces of mail, as a rule, are shifted more or less relative to each other so that three segments are produced. Due to the arbitrary formats of the two pieces of mail, all combinations are to be assumed for the previous and subsequent pieces of mail. As a rule there are three segments, wherein no statement can be made about their length. Main characteristic features: number of segments equal 1 to 3, $S_1$ of mono maximum type (can disappear in special cases), $S_2$ of bi maximum type, $S_3$ of mono maximum type (can disappear in special cases). The line width is viewed segment by segment and edge by edge. The average line width ranges from thin to thick and is in direct proportion to the thickness of the piece of mail. The line widths belonging to similar pieces of mail are the same size over all segments and edges. A skew is characterized by $(S_1+S_2+S_3)<Z_L$.

In each hypothesis, some characteristics will be according higher weight that others in deciding whether a condition such as a double, folded edge of the like is present. For example, as to a double, each of the two visible edges represents one of the two pieces of mail: $L_{Sdg1}=L_{S1}+L_{S2}$ and $L_{Sdg2}=L_{S2}+L_{S3}$, but this has a lesser weight than other characteristics discussed above. The contrast of a double gives a characteristic frequency distribution that is determined experimentally from the training sample. The characteristic feature, frequency distribution, gets a moderate weight compared to the main characteristic features listed above.

Figure 16:
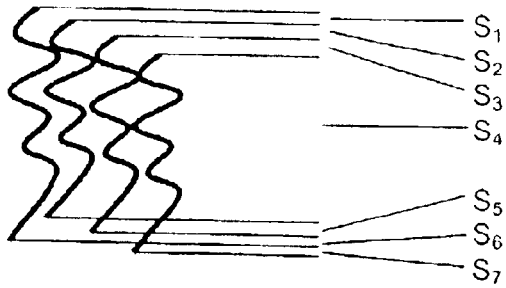
FIG. 16 is a schematic illustration of a multiple feed standard hypothesis.

A standard hypothesis for a multiple is shown in FIG. 16. The standard multiple copy consists of more than two pieces of mail pulled off together. As a rule, the edges of the pieces of mail are shifted relative to each other more or less so that three segments are produced. Due to arbitrary formats of the pieces of mail, all combinations are to be assumed for the preliminary and subsequent pieces of mail.

In the example shown, there are 4 pieces of mail and 7 segments; in general, N pieces of mail generate 2N−1 segments in the imaging of the edges of the pieces of mail. No statement can be made about the length of the segments. Characteristic features of a multiple are: number of segments=5 to 2N−1, $S_1$ of mono maximum type, $S_2$ of bi maximum type, $S_3$ of tri maximum type, $S_4$ of quad maximum type, $S_5$ of tri maximum type, $S_6$ of bi maximum type, $S_7$ of mono maximum type.

Software implementing the selected hypotheses analyses the camera image and takes action (pass or reject) based on the result. The decision can be made fast enough so that doubles or multiples in a fast moving series of conveyed mail pieces can be diverted, i.e., controller 22 should have sufficient power to make the decision between the time the mail piece(s) pass apparatus 10 and the time they reach the first divert of the sorting machine.

Although various embodiments of the invention have been illustrated in the accompanying drawing and described in the foregoing detailed description, it will be understood that the invention is not limited to the embodiments disclosed but, as will be appreciated by those skilled in the art, is susceptible to numerous modifications and variations without departing from the spirit and scope of the invention as hereinafter claimed.

What is claimed is:

1. A method for detecting overlapped mailpieces when singulating batches of flat mail pieces as the pieces are conveyed on their narrow sides, whereby the sorted mail pieces are moved successively standing on their narrow sides in a longitudinal direction along a bed or belt path, whereas positioned below the transport path is an electronic line camera with its optical longitudinal axis perpendicular to the transport direction of the mail pieces that scans the bottom edges of the mail pieces through an aperture in the base plate whereas two sources of light are positioned laterally from the mailpiece bottom edges in order to diagonally illuminate the bottom edges of the mail pieces from below as the mail pieces pass over the aperture of the base plate so that the bottom edges of the scanned mailpieces are emphasized by shadowing, furthermore the output of the electronic line camera is fed to an evaluation means which calculates the statistical characteristics of the line by line scanned mailpiece bottom edge image and compares them with those of off-line predetermined sets of characteristics derived from typical samples of bottom edge images representing different physical class models of known single feed as well as double feed bottom edge image constellations, in order to determine as the decision result the class model with the highest probability of representing the measured characteristics.

2. A method according to claim 1, whereas a suitable set of statistical characteristics of the scanned lines are determined and moreover lines with a similar subset of characteristics are grouped to segments and moreover suitable characteristics of these segments are calculated in order to compare all these line and segment related characteristics, like average line intensity, number of maxima per line and order of segments, with the corresponding characteristics of the off-line predetermined physical class models and moreover the class model with the highest degree of correspondence is chosen as the detection result.

3. A method according to claim 1, whereas the radiation of the light source may be in the visible as well as in the invisible range of wavelength like infrared.

4. A method according to claim 1, whereas the lens of the electronic line camera is dust protected by a glass plate which is located out of focus of the lens.

5. A method for detecting doubles, when singulating batches of flat mail pieces as the pieces are conveyed on their narrow sides, whereby the sorted mail pieces are moved successively standing on their narrow sides in a longitudinal direction along a bed or belt path, furthermore located below the transport path is an electronic line camera with its optical longitudinal axis perpendicular to the transport direction of the mail pieces that scans the bottom edges of the mail pieces through an aperture in the base plate, furthermore the statistical characteristics of the line by line scanned mailpiece bottom edge image were compared with those of off-line predetermined sets of characteristics derived from typical samples of bottom edge images representing different physical class models of known single feed as well as double feed bottom edge image constellations, in order to determine as the decision result the class model with the highest probability of representing the measured characteristics.

6. A method according claim 5, using a suitable set of statistical characteristics of the scanned lines, which are determined and moreover lines with a similar subset of characteristics are grouped to segments and furthermore suitable characteristics of these segments are calculated in order to compare all these line and segment related characteristics, like average line intensity, number of maxima per line and order of segments, with the corresponding characteristics of the off-line predetermined physical class models and moreover the class model with the highest degree of correspondence is chosen as the detection result.

7. A method according to claim 4, whereas the dust protection glass plate of the electronic line camera and the emitter of light are additionally dust protected by a positive pressured airflow.

8. A method according to claim 4, whereas before the aperture of the electronic line camera positive pressured air blows perpendicular to the mail transport between the base plate and the bottom edges of the mail pieces in order to deflect dust particles from the mail path and therefore to reduce the amount of dust particles falling into the aperture.

9. A method according to claim 4, whereas before the dust protection glass plate of the electronic line camera positive pressured air blows perpendicular to the optical axis in order to deflect dust particles from the lens protection glass plate and therefore to reduce the amount of dust particles affecting the glass plate transparency.

10. An apparatus for detecting overlapped mail pieces when singulating batches of flat mail pieces:

a conveyor for conveying the mail pieces their narrow sides, whereby the sorted mail pieces are moved successively standing on their narrow sides in a longitudinal direction along a bed or belt path;

a camera positioned below the transport path with its optical longitudinal axis perpendicular to the transport direction of the mail pieces for scanning the bottom edges of the mail pieces through an aperture in the conveyor at least one source of light positioned laterally from the mailpiece bottom edges in order to diagonally illuminate the bottom edges of the mail pieces from below as the mail pieces pass over the aperture so that the bottom edges of the scanned mailpieces are emphasized by shadowing;

means for evaluating the output of the camera by calculating statistical characteristics of the mail piece bottom edge image and comparing them with those of off-line predetermined sets of characteristics derived from typical samples of bottom edge images representing different physical models including single feed and double feed bottom edge images, in order to determine as the decision result the physical model with the highest probability of representing the measured characteristics.

11. The apparatus of claim 10, wherein the camera is an electronic line camera.

12. The apparatus of claim 10, wherein two sources of light are positioned laterally from the mailpiece bottom edges in opposing positions in order to diagonally illuminate the bottom edges of the mail pieces from below as the mail pieces pass over the aperture so that the bottom edges of the scanned mail pieces are emphasized by shadowing.

* * * * *